United States Patent [19]

Kosuda et al.

[11] 4,347,812

[45] Sep. 7, 1982

[54] HYDRAULIC VALVE LIFT DEVICE

[75] Inventors: Tooru Kosuda, Okazaki; Michihiro Ohashi, Handa; Yasuhiro Takeuchi, Okazaki; Tadahide Toda, Mishima; Noboru Matsubara, Susono; Masaaki Takizawa, Mishima, all of Japan

[73] Assignees: Nippon Soken, Inc., Nishio; Toyota Jidosha Kogyo Kabushiki Kaisha, Toyota, both of Japan

[21] Appl. No.: 34,186

[22] Filed: Apr. 27, 1979

[30] Foreign Application Priority Data

Apr. 28, 1978 [JP] Japan ..... 53-51337
Jun. 6, 1978 [JP] Japan ..... 53-68073

[51] Int. Cl.[3] ..... F01L 1/24

[52] U.S. Cl. ..... 123/90.55; 123/90.16

[58] Field of Search ..... 123/90.12, 90.15, 90.16, 123/90.52, 90.53, 90.55, 90.56, 90.57, 321, 346, 347

[56] References Cited

U.S. PATENT DOCUMENTS 3,490,423 6/1968 Shunta et al. ..... 123/90.16
3,636,932 1/1972 Hamilton et al. ..... 123/90.57
3,727,595 4/1973 Links ..... 123/90.15
4,111,165 9/1978 Aoyama et al. ..... 123/90.15
4,112,884 9/1978 Tominaga ..... 123/90.57

FOREIGN PATENT DOCUMENTS 2252021 6/1975 France ..... 123/90.57

*Primary Examiner*—Craig R. Feinberg
*Assistant Examiner*—W. R. Wolfe
*Attorney, Agent, or Firm*—Cushman, Darby & Cushman

[57] ABSTRACT

A hydraulic valve lift device for transmitting the motion of a cam to a push rod of an intake or exhaust valve of an engine, including a housing, a lifter slidably engaged by the housing and provided therein with an oil pressure chamber adapted to receive an oil, and a plunger provided with a flange portion and slidable in relation to the lifter. The flange portion of the plunger and cylindrical bore of the housing cooperate with each other to define therebetween a braking chamber into which oil is introduced. The device has a slit through which the oil in the braking chamber is relieved to the outside. The arrangement is such that the rate of oil relieved through the braking chamber is reduced as the plunger is lowered. The device further includes a relief valve for maintaining the pressure in the braking chamber below a predetermined pressure level.

11 Claims, 7 Drawing Figures

HYDRAULIC VALVE LIFT DEVICE

BACKGROUND OF THE INVENTION

The present invention relates to a hydraulic valve lift device for internal combustion engine and, more particularly, to a hydraulic valve lift device adapted for relaxing impacts at the time of setting of the valve.

There have been proposed various types of valve lift devices for varying the valve or timing in accordance with load imposed on the engine or running speed of the engine. One of these known devices, which is basically identical to a known hydraulic tappet device, the oil in an oil chamber pressurized by a plunger engaging a push rod and by a lifter body is allowed to be relieved to the outside through a restriction or orifice so as to reduce the volume of the oil chamber, thereby to change the lift of the plunger.

In this valve lift device, the cam contour is two dimensional, and it is not necessary to change relative positions of the cam shaft and the plunger to each other, so that the construction of the device is considerably simple. However, since the device is constructed to vary the valve lift by relieving the oil from the oil chamber, it is impossible to make the cam have such a cam contour involving a curvature for reducing the movement of the intake and exhaust valves at the instant of seating as in the cam commonly used in engines. Therefore, a large impact force acts on the valve at the time of seating, generating a large noise and causing various inconveniences on the durability of the valve mechanism.

SUMMARY OF THE INVENTION

It is therefore an object of the invention to provide a hydraulic valve lift device capable of effectively absorbing the impact at the time of seating of the valve to reduce the noise and to afford a longer life of the valve mechanism, thereby to overcome above described problem of the prior art.

To this end, according to the invention, there is provided a hydraulic valve lift device having a braking chamber defined by a flange formed on a plunger in cooperation with the cylindrical bore of a housing. The braking chamber is adapted to be supplied with oil through a slit during upward stroking of the plunger. The amount of oil relieved from the braking chamber is reduced during the downward stroke of the plunger, in accordance with the reduction of opening area of the slit. Consequently, the increased hydraulic pressure in the braking chamber imparts a braking force to the plunger so as to effectively absorb the impact at the time of seating of the intake or exhaust valve.

According to an aspect of the invention, the hydraulic pressure in the braking chamber is controlled and maintained below a predetermined level, so that an adequate braking force is imparted on the intake and exhaust valves over a wide range of speed of engine, from a low speed to a high speed. Therefore, an impacting application of braking force on the valve mechanism such as push rod, as well as a large delay of timing of seating of the valve, is fairly avoided.

DESCRIPTION OF THE PREFERRED EMBODIMENT

Figure 1:
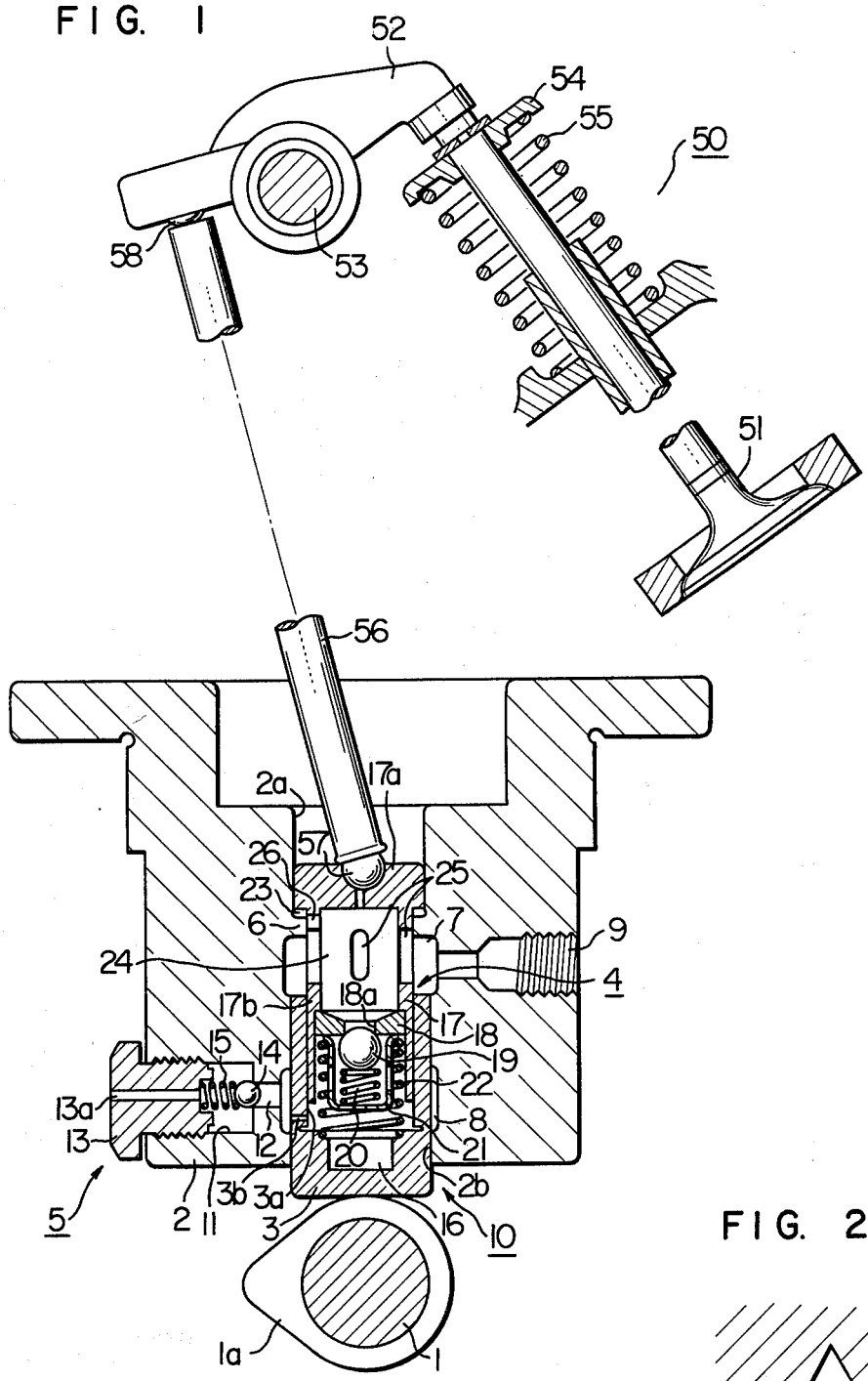
FIG. 1 is a sectional side elevational view of a hydraulic valve lift device of the invention mounted on an internal combustion engine.

Referring first to FIG. 1, a variable valve lift device of the invention, generally designated at reference numeral 10, is interposed between a cam 1*a* on a cam shaft 1 and a valve device 50 of an OHV 4-stroke cycle engine, and is attached to the cylinder block (not shown) of the engine. The cam shaft 1 on which the cam 1*a* is mounted rotates in synchronism with the rotation of the crank shaft of the engine.

The valve device 50 includes a rocker arm 52 rockably carried by a rocker arm shaft 53, a valve 51 engaged at its one end by the rocker arm 52, a valve spring retainer 54 formed on the stem of the valve 51, and a valve spring 55 surrounding the valve stem and acting between the valve retainer 54 and the engine housing.

The rocker arm 52 is adapted to driven by a push rod 56 and drives the valve 51 (or an exhaust valve) to open and close the latter.

The variable valve lift device 10 has a housing 2 formed with upper and lower cylindrical bores 2*a*, 2*b*, a cylindrical lifter 3 slidably engaged in the lower cylindrical bore 2*b*, a plunger device 4 slidably engaged in a cylindrical bore 3*a* of the lifter 3, and an oil ejecting device generally designated by numeral 5 and provided on the housing 2.

As will be seen from FIG. 1, the upper and lower cylindrical bores 2*a*, 2*b* of the housing 2 are coaxial with each other, and are separated from each other by a shoulder 6 and an annular oil feed groove 7. The lower cylindrical bore 2*b* is provided at its intermediate portion with an annular relief groove 8, and slidably accommodates a lifter 3.

The housing 2 is provided with an oil inlet port 9 through which oil delivered by an oil pump (not shown) is introduced. The oil inlet port is in communication with an oil supply groove 7. At the lower portion of the housing 2 is formed a bore 11 for accommodating the oil ejecting device 5. The bore 11 is in communication with the oil relief groove 8 through an oil relief port 12.

The oil ejecting device 5 has a cap member 13 adapted to be screwed into the bore 11 of the housing 2, a check ball 14 adapted to be seated on the peripheral edge of the oil relief port 12 and a coiled spring 15 disposed between the cap member 13 and the check ball 14. The cap member 13 has a communication port 13*a* which is communicated with the outside of the valve device, e.g. an oil chamber (not shown) of the cylinder block. The lifter 3 is provided therein with an oil pressure chamber 16 and a cylindrical guide bore 3*a* which is in communication with the relief groove 8 of the housing 2 through an orifice port 3*b*.

The plunger device 4 includes a plunger 17, a seat member 18 fixed to the inside of the plunger 17, a check ball 19 biased against the central bore 18*a* of the seat member 18 by a coiled spring 20, and a cup-shaped member 21 biased against the seat member 18 by a coiled spring 22. The coiled spring 22 is interposed between the shoulder of the cylindrical bore 3*a* of the lifter 3 and a flange of the cup-shaped member 21 so as to press the cup-shaped member 21 against the seat member 18. The plunger 17 comprises a flange portion 17*a* slidably fitted in the upper cylindrical bore 2*a* of the housing 2, and a cylindrical portion 17*b* slidably fitted in the cylindrical bore 3*a* of the lifter 3. The flange portion 17*a* and cylindrical portion 17*b* incooperate with the upper cylindrical bore 2*a* of the housing and the shoulder portion 6 to define a braking chamber 23.

The flange portion 17*a* of the plunger 17 is provided with a generally hemispherical recess adapted to receive a connecting ball 57 integrally attached to one end of the push rod 56. Meanwhile, a connecting ball at the other end of the push rod 56 is engaged by the rocker arm 52 so as to form a spherical connecting construction. The cylindrical portion 17*b* of the plunger 17 is provided therein with an oil feed chamber 24 and a cylindrical bore for receiving the seat member 18. The oil feed chamber 24 is maintained in communication with the oil feed groove 7 of the housing 2 by means of a plurality of oil feed ports 25 in the form of elongated bores.

Figure 2:
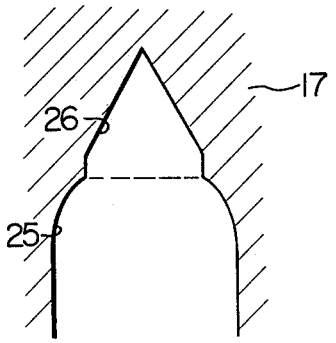
FIG. 2 is an enlarged view of a part of the valve lift device showing particularly a slit formed in the valve lift device.

As will be seen from FIG. 2, one of the oil feed ports 25 is provided with a triangular slit 26 through which the oil feed chamber 24 is kept in communication with the braking chamber 23. The area of the opening of the slit 26 to the braking chamber 23 is adjusted by means of the shoulder 6 of the housing 2.

In operation, when the lifter 3 rests on the lowermost part of the cam contour of the cam 1*a*, the oil coming from the oil inlet port 9 is allowed to flow into the oil feed chamber 24 through the oil feed groove 7 and the oil feed port 25 of the plunger 17.

A part of the oil having come into the oil feed chamber 24 then flows into the braking chamber 23 through the slit 26 and the variable restricting port defined by the shoulder 6 of the housing. Meanwhile, another part of oil in the oil feed chamber 24 acts on the check ball 19 to move it away from the central bore 18*a* of the seat member 18, and then flows into the oil pressure chamber 16 of the lifter 3.

The pressurized oil thus introduced into the oil feed chamber 24 and the oil pressure chamber 16 acts to bias the plunger 17 and lifter 3 away from each other. The oil having come into the oil pressure chamber 16 acts on the check ball 14 through the restriction port 3*b*, relief groove 8 and oil relief port 12, and then flows to the outside, forcibly moving the check ball 14 away from the oil relief port 12.

Then, as the cam 1*a* starts to lift the lifter 3 due to the rotation of the cam shaft 1, the oil pressure in the oil pressure chamber 16 begins to be increased so as to make the check ball 19 close to the central bore 18*a* of the sheet member 18. Consequently, the oil pressure in the oil pressure chamber 16 is increased to raise the plunger 17 overcoming the force of the valve spring 55 which is transmitted through the push rod 56, thereby to open the valve 51.

Meanwhile, the oil in the oil pressure chamber 16 continuously relieved to the outside through the restriction port 3*b* and relief groove 8 forcibly urges the check ball 14. The volume in the oil pressure chamber 16 is therefore reduced gradually.

As the plunger 17 is moved upward due to a rise of pressure in the oil chamber 16, oil flows from the oil chamber 24 into the braking chamber 23 through the slit 26 and oil feed ports 25. Meanwhile, the oil in the oil pressure chamber 16 continuously flows to the outside through the restriction port 3*b* so as to gradually decrease the volume in the oil pressure chamber. Consequently, the maximum lift of the plunger 17 is smaller than that of lifter 3. Namely, the lift of the plunger 17 is determined by the amount of oil relieved from the oil pressure chamber 16. When the rotational speed of the cam shaft 1 is low, the lift of the plunger 17 is made smaller. When the rotational speed of the cam shaft increases, the amount of oil relieved from the oil pressure chamber is gradually reduced to cause the lift to be determined depending on the cam contour of the cam 1*a*.

Since the volume of the oil pressure chamber 16, i.e. the lift of the plunger 17 is changed depending on the rotational speed of the cam shaft 1, the position or timing at which the cam 1*a* of the cam shaft 1 comes into contact with the lifter 3, when the plunger 17 is at the state before the lifter 3 is contacted and lifted by the cam 1*a*, i.e. in the state in which the valve 51 (or exhaust valve) of the engine is closed, is changed in accordance with the speed of rotation of the cam shaft.

When the engine is operating at a low speed, the oil in the braking chamber 23 flows into the oil feed chamber 24 through the slit 26 and oil feed ports 25, as the plunger 17 begins to move downward. As the plunger 17 is further lowered to make the oil feed ports 25 completely closed by the shoulder 6 formed in the housing 2, the slit 26 commences to restrict the flow of the oil from the braking chamber 23 to the oil feed chamber 24. As a result, the pressure in the braking chamber 23 is increased to act against the lowering of the plunger 17. Thus, the opening area of the slit 26 through which the braking chamber 23 and oil feed chamber 24 are connected is gradually restricted and reduced by the shoulder 6 of the housing, so that the discharge rate of the oil from the braking chamber 23 is gradually decreased increasing the pressure therein. This in turn increases the counter force acting against the lowering of the plunger 17 so as to effect a braking on the plunger 17 immediately before the valve 51 (or exhaust valve) is seated, thereby to reduce the speed of the valve 51 at the instant of seating. The lifter 3 is maintained in pressure contact with the cam 1*a* of the cam shaft 1 by the action of the coiled spring 22. As the lifter 3 is lowered due to the rotation of the cam shaft 1, the oil pressure in the oil pressure chamber 16 comes down below the predetermined level, so that the check ball 19 is moved away from the central bore 18*a* of the seat member 18 so as to allow oil to flow from the oil feed chamber 24 into the oil pressure chamber 16.

Since the slit 26 has a form of restriction or orifice port as shown in FIG. 2, the valve operation is scarcely influenced by the change of viscosity of oil due to change of temperature or the like reasons, a stable braking effect is ensured constantly.

Figure 3A:
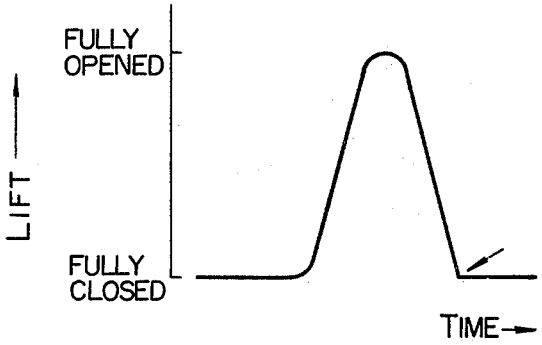
FIG. 3A is a chart showing the relation between the valve lift of a valve and time, in a valve lift device provided with no oil brake means.
Figure 3B:
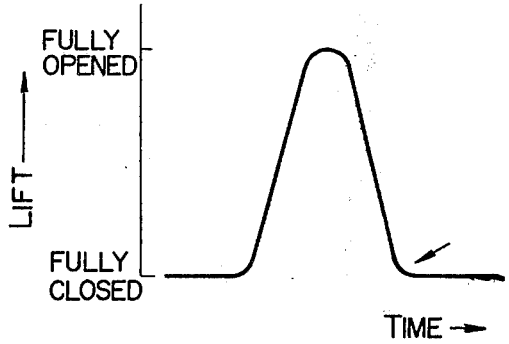
FIG. 3B is a chart showing the relation between the valve lift of a valve and time, in the valve lift device of the invention.

FIGS. 3A and 3B, respectively, show the valve lift of the valve 51 as obtained with a hydraulic valve lift device having no braking chamber and the valve lift of the same valve 51 as obtained with the valve lift device of the invention having the braking chamber 23. In these Figures, the valve lifts are represented by the ordinate, while the abscissa represent time. As shown in FIG. 3A, the valve 51 associated with the valve lift device is fully closed abruptly to generate a large impact force, whereas, in case of the valve lift device of the invention, the valve is closed gradually and gently due to the action of the braking chamber 23, so that no substantial impact force is generated.

Figure 4:
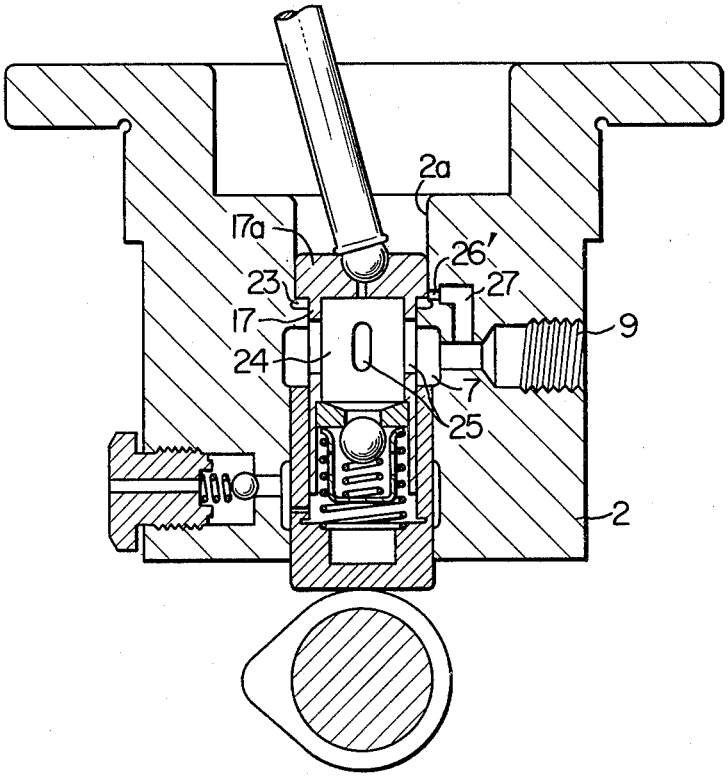
FIG. 4 is a sectional side elevational view of a valve lift device constructed in accordance with another embodiment of the invention.

FIG. 4 shows an alternative construction in which a slit 26' corresponding to the slit 26 is formed in the wall of the upper cylindrical bore 2*a* of the housing 2, and the opening area is changed by the flange portion 17*a* of the plunger 17. In this case, the slit 26' communicates the oil inlet port 9 through a passage 27 so as to deliver the oil to the braking chamber 23.

Figure 5:
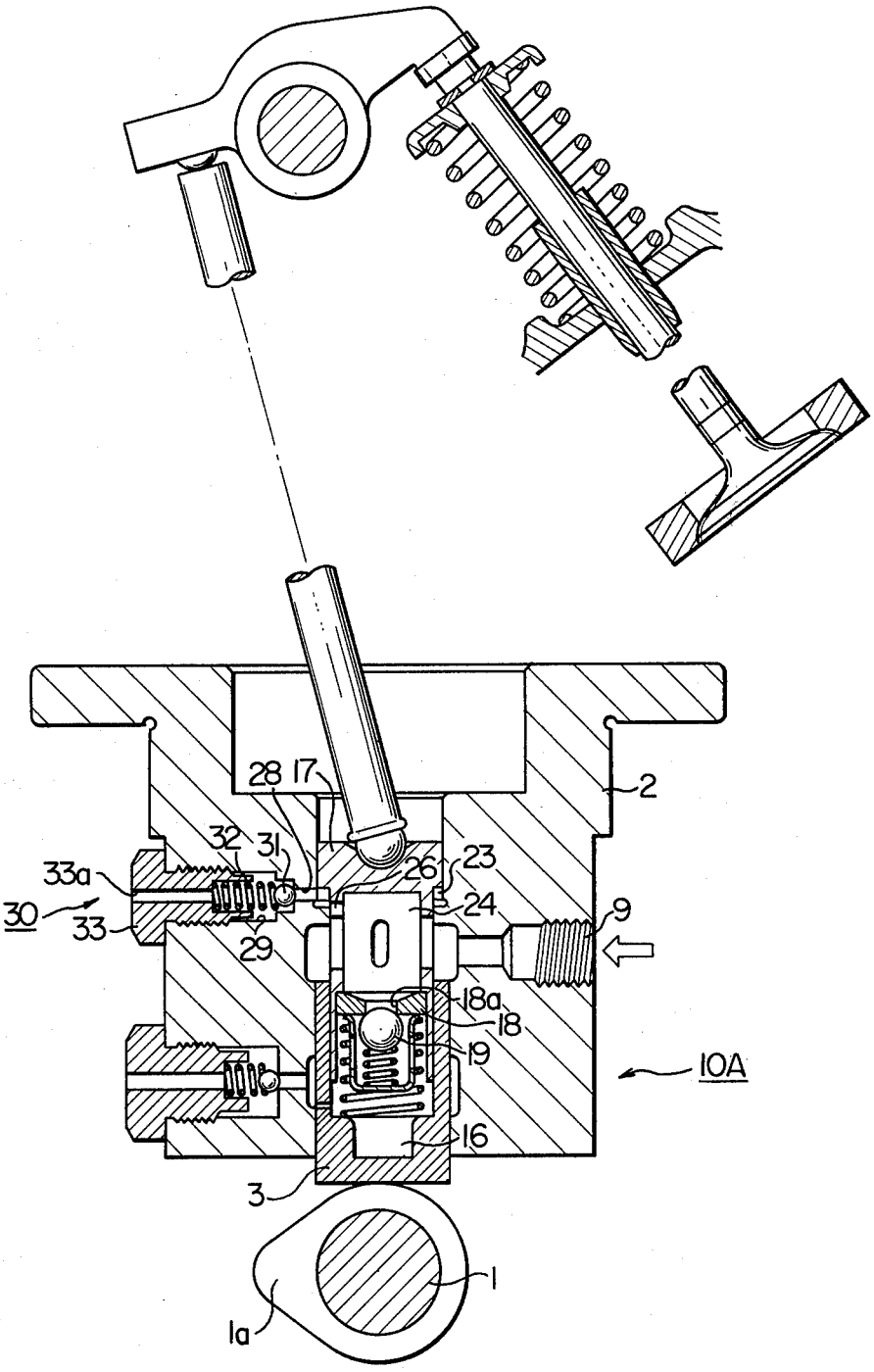
FIG. 5 is a sectional side elevational view of a valve lift device constructed in accordance with another embodiment of the invention.

FIG. 5 shows a variable valve lift device constructed in accordance with another embodiment of the invention, generally designated by numeral 10A. This valve lift device 10A differs from the valve lift device 10 of the previously described embodiment in the following points.

A second oil relief port 28 is formed in the wall of housing 2. This second oil relief port 28 is opened to the outer surface of the housing 2 through a second bore 29. The second oil relief port 28 is in communication with the braking chamber 23. An oil relief valve device generally designated by numeral 30 is received by the second bore 29 of the housing 2. This oil relief valve device 30 includes a check ball 31, a compression coiled spring 32 and a second cap member 33. The second cap member 33 is provided with a through bore 33*a* which communicates with the oil chamber of the cylinder block, and is screwed into the second bore 29 of the housing 2. The compression spring 32 interposed between the second cap member 33 and the check ball 31 is adapted to bias the check ball against the second oil relief port 28.

In operation, as the cam 1*a* begins to raise the lifter 3 after a rotation of the cam shaft 1, the oil pressure in the oil pressure chamber 16 is increased to seat the check ball 19 on the central bore 18*a* of the sheet member 18, thereby to lift the plunger 17 upward. The rise of the plunger 17 in turn causes the oil to flow from the oil feed chamber 24 into the braking chamber 23 through the slit 26. Since the relief valve constituted by the compression coiled spring 32, check ball 31 and second relief port 28 is set to open at a predetermined pressure which is higher than the pressure of the oil supplied through the oil feed port 9, the oil does never flow out through the second oil relief port 28.

When the engine is operating at a relatively low speed, the speed at which the plunger 17 is lowered is correspondingly low, so that the oil pressure in the braking chamber 23 does not come to exceed the above mentioned predetermined pressure. Therefore, the oil does not flow out from the braking chamber 23 through the second port 28 of the housing.

As the engine speed is increased, the speed at which the plunger 17 is lowered is increased correspondingly. Since the pressure in the braking chamber 23 is increased at a rate substantially proportional to the square of the lowering speed of the plunger 17, so that a high pressure is established in the braking chamber 23. Consequently, the oil in the braking chamber 23 flows out through the second relief port 23, forcibly moving the check ball 31 away from the second oil relief port 28, thereby to prevent the oil pressure in the braking chamber 23 from becoming higher than the set pressure. Owing to the described function of the oil relief valve device, an application of impact force to the push rod and associated members, as well as undesirable delay of the seating of the valve, which would otherwise be caused due to an excessively high pressure generated in the braking chamber 23 is fairly avoided. As a result, a stable braking effect can be obtained over a wide range of engine speed covering considerably low and high speeds.

Figure 6:
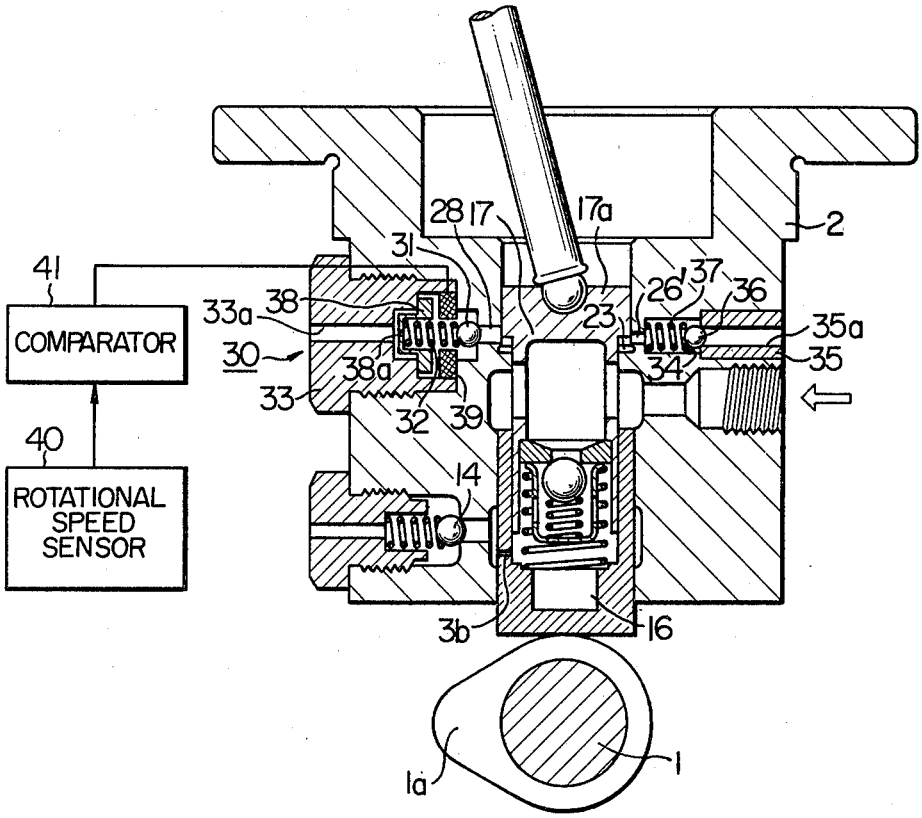
FIG. 6 is a sectional side elevational view of a valve lift device constructed in accordance with still another embodiment of the invention.

FIG. 6 shows still another embodiment of the invention. This embodiment differs from those shown in FIGS. 1 and 5 in the following points.

In this embodiment, a slit 26' is formed in the housing 2, but not in the plunger 17, and the opening area of the slit 26' is changed by the flange portion 17*a* of the plunger 17. The housing 2 is further provided with a bore 34 which is in communication with the slit 26'.

This bore 34 receives a plug 35, check ball 36 and coiled spring 37. An oil feed port 35*a* is formed in the plug 35, against which the check ball 36 is biased by the force of the spring 37. Oil is introduced from the outside into the braking chamber 23 through the oil feed port 35*a*, check ball 36 and slit 26' as the plunger 17 is raised. Then, as the plunger 17 is lowered, the oil pressure in the braking chamber 23 is increased to press the check ball 36 against the oil feed port 35*a* to close the latter.

The oil relief valve device 30 includes a retainer 38 made of iron and a solenoid 39, in addition to the check ball 31, coiled spring 32 and second cap member 33. The coiled spring 32 presses at its one end the retainer 38, and the position of the retainer can be altered by means of the solenoid 39.

More specifically, the solenoid 39 serves to attract the retainer 38 so as to preload the spring 32, thereby increasing the pressure required for opening the check ball 31. As the check ball 31 is moved away from the second oil relief port 28, the oil is relieved to the outside through the second oil relief port 28, bore 38*a* of the retainer 38 and bore 33*a* of the second cap member 33.

The control of the energization of the solenoid 39 is effected in accordance with the operating condition of the engine, e.g. the speed of the engine. A circuit for controlling the energization of the solenoid 39 includes a speed sensor 40 of a known type for producing a voltage corresponding to the rotational speed of the engine shaft. The output voltage derived from the speed sensor 40 is delivered to a comparator circuit 41, of which output controls the energization of the solenoid 39.

The comparator circuit 41 serves to compare the output voltage from the speed sensor 40 with a set voltage, and produces a signal for de-energizing the solenoid 39 so as to lower the pressure required for opening the check ball 31, when the output voltage from the speed sensor 40 takes a low level, i.e. when the engine speed is relatively low.

To the contrary, when the output voltage from the speed sensor 40 is higher than the set voltage, i.e. when the engine speed is comparatively high, the solenoid 39 is energized to attract the retainer 38, thereby increasing the level of pressure required for opening the check ball 31.

Thus, the oil pressure in the braking chamber 23 is suitably controlled by means of the check ball 31, such that the braking effort exerted by the oil pressure in the oil pressure chamber is lowered when the engine speed is low and such that the braking effort is increased when the engine speed is high. Consequently, an adequate braking force is imparted to the plunger 17 dependent upon the varying engine speed.

If the arrangement is such that the restriction port 3*b* is opened and closed by a member (not shown) in accordance with the level of the load imposed on the engine, the plunger 17 strictly follows the cam contour of the cam 1*a*, particularly when the port 3*b* is closed, so that it is possible to make use of a impact buffering curve of the cam contour for relaxing the impact at the time of seating of the valve. In such a case, another control method, e.g. to keep the level of the pressure for opening the check ball 31, can be adopted in place of the above described control.

Having described the invention through specific preferred embodiments, it is to be noted that these embodiments are not exclusive, and various changes and modifications may be imparted thereto without departing from the scope of the invention which is limited solely by the appended claims.

What is claimed is:

1. In a hydraulic valve lift device for transmitting the movement of a cam to a combustion chamber valve of an internal combustion engine, which device includes a housing, a lifter slidably engaged in housing bore means, and a plunger slidably-engaged in said bore means and slidable in relation to said lifter and defining therewith an oil pressure chamber into which oil is introduced under pressure, said plunger being extended to move said valve away from its seating position and retracted to move said valve toward its seating position, the improvement comprising:

means defining a braking chamber between said plunger and said bore means, said chamber having opposed end walls and opposed side walls and being adapted to receive oil; and slit means in one of said side walls forming a portion of a passage to relieve oil from said braking chamber as said plunger is retracted, said slit means having an opening area variable by movement of said plunger such that said opening area is gradually reduced as said plunger is retracted.

2. A hydraulic valve lift device as claimed in claim 1, further comprising a relief valve for maintaining the pressure in said braking chamber at a level below a predetermined level.

3. A hydraulic valve lift device as claimed in claim 2, further comprising means for changing the set pressure of said relief valve depending on the condition of operation of said engine.

4. A hydraulic valve lift device as claimed in claim 2 including:

a speed sensor for sensing the rotational speed of the engine; and control means operable upon receipt of a signal from said sensor for lowering the pressure required for opening the relief valve when the engine speed is lower than a set value and for raising the pressure required for opening said relief valve when the engine speed is higher than the set value.

5. A hydraulic valve lift device as claimed in claim 4 wherein said control means comprises a comparator circuit.

6. A hydraulic valve lift device as claimed in claim 4 wherein oil is introduced through said slit means into said braking chamber from said oil pressure chamber as said plunger is extended.

7. A hydraulic valve lift device as claimed in claim 2, wherein said relief valve includes a check ball which is biased by a compression spring against an oil relief port communicating with said braking chamber so as to close said oil relief port, whereby said oil is relieved from said braking chamber when said predetermined level of oil pressure is exceeded by the pressure in said braking chamber.

8. A hydraulic valve lift device as claimed in claim 7, further comprising means for changing the set pressure of said relief valve depending on the condition of operation of said engine.

9. A hydraulic valve lift device as claimed in claim 3 including wherein said relief valve comprises a solenoid adapted to be controllably energized by said control means and including a convex-shaped member adapted to be moved by said solenoid and a spring of which biasing force against the check ball is varied by said member.

10. A hydraulic valve lift device as claimed in any one of claims 1 to 8 wherein said slit means is formed in said plunger.

11. A hydraulic valve lift device as claimed in any one of claims 1 to 8 wherein said slit means is formed in said housing.

* * * * *